US005878648A

United States Patent [19]

Dworak

[11] Patent Number: 5,878,648

[45] Date of Patent: Mar. 9, 1999

[54] ADJUSTABLE RADIAL PISTON MACHINE

[75] Inventor: Wilhelm Dworak, Stuttgart, Germany

[73] Assignee: Robert Bosch GmbH, Stuttgart, Germany

[21] Appl. No.: 1,234

[22] Filed: Dec. 30, 1997

[30] Foreign Application Priority Data

Jan. 29, 1997 [DE] Germany ..... 197 03 155.2

[51] Int. Cl.[6] ..... F01B 1/06

[52] U.S. Cl. ..... 92/12.1; 92/58; 92/72; 417/219

[58] Field of Search ..... 92/12.1, 72, 58; 417/269, 221, 218, 219

[56] References Cited

U.S. PATENT DOCUMENTS

| | | | |
|---|---|---|---|
| 4,634,349 | 1/1987 | Abe et al. | 417/219 |
| 5,651,301 | 7/1997 | Thoma et al. | 417/219 X |

FOREIGN PATENT DOCUMENTS

| | | |
|---|---|---|
| 659 943 | 4/1938 | Germany . |
| 34 33 289 A1 | 3/1986 | Germany . |
| 41 43 152 A1 | 7/1993 | Germany . |
| 1 408 861 | 10/1975 | United Kingdom . |
| 2 254 373 | 10/1992 | United Kingdom . |

*Primary Examiner*—Hoang Nguyen
*Attorney, Agent, or Firm*—Michael J. Striker

[57] ABSTRACT

An adjustable radial piston machine (pump or motor) is described whose drive mechanism (10) has a comparatively compact structure and an especially good mechanical efficiency. The drive mechanism (10) has a bearing ring (19) which is arranged concentric to a rotor (11) and which can be swung or pivoted about a symmetry axis (Q,H) different from its rotation axis for adjustment of the radial piston machine. An adjusting device (22) for pivoting the bearing ring extends axially parallel to the bearing ring (19) and acts on a facing surface of the bearing ring (19). Working pistons (13) guided in the cylinders in the rotor perform two motion cycles per revolution of the rotor, which are equal, but in opposite directions, over respective 180° angular intervals. Cylinders (12) on opposite sides of the rotor are acted on by identical pressures so that the forces on the rotor are balanced and the rotor rotates largely free of friction.

6 Claims, 1 Drawing Sheet

ADJUSTABLE RADIAL PISTON MACHINE

BACKGROUND OF THE INVENTION

The present invention relates to an adjustable radial piston machine, especially a pump or motor, and, more particularly, to an adjustable radial piston machine comprising a housing having an interior space, a drive mechanism arranged in the interior space and comprising a rotor coupled nonrotatably to a drive shaft or driven shaft outside the housing and provided with a plurality of radially arranged cylinders and working pistons movable in the respective cylinders, a stationary control pivot on which the rotor is rotatably mounted and which is provided with at least one feed duct and/or at least one outlet duct opening into respective control cavities, a bearing ring surrounding the rotor on which the working pistons bear and an adjusting device with which the bearing ring cooperates for adjustment of the operation of the radial piston machine.

A radial piston machine of this type is for example described in German Patent Application DE 41 43 152.9 A1. This radial piston machine has a drive mechanism, which is formed by a rotatably mounted rotor including radially arranged working cylinders. Pistons are guided movably in the working cylinders, which bear on a bearing or piston ring, which surrounds the rotor. The bearing ring is movable as a whole in a straight line relative to the housing for adjustment of the radial piston machine and cooperates with a hydraulic piston-cylinder device for that purpose. The eccentricity present between the bearing ring and the rotor is appropriately adjusted by an appropriate control of the hydraulic piston-cylinder device and thus the operating parameters of the radial piston machine are changed.

The disadvantage to this prior art arrangement is that the hydraulic forces on the rotor produced by the operating cylinders during operation of the radial piston are not balanced. Because of that the rotor bearings are loaded with frictional forces which impair the mechanical efficiency of the radial piston machine. Moreover the frictional forces lead to heating and/or to wear which in the extreme case can lead to seizing and/or to mechanical destruction of the drive mechanism components.

SUMMARY OF THE INVENTION

It is an object of the present invention to provide an improved adjustable radial piston machine, pump or motor, which does not have the above-described disadvantages.

This object, and others which will be made more apparent hereinafter, are attained in an adjustable radial piston machine comprising a housing having an interior space, a drive mechanism arranged in the interior space and comprising a rotor coupled nonrotatably to a drive shaft or driven shaft extending outside the housing and provided with a plurality of radially arranged cylinders and working pistons guided movably in the respective cylinders, a stationary control pivot on which the rotor is rotatably mounted in the housing and which has at least one feed duct and/or at least one outlet duct opening into respective control cavities in the housing, a bearing ring surrounding the rotor on which the working pistons bear and an adjusting device with which the bearing ring cooperates for adjustment of the operating parameters of the radial piston machine.

According to the invention, the bearing ring is arranged concentric to the rotor, has a symmetry axis different from its rotation axis and is pivotally mounted for pivoting about the symmetry axis.

The adjustable radial piston machine according to the invention has the advantage that the hydraulic forces acting on the rotor are kept in balance. Because of that there are almost no frictional forces acting on the rotor bearings, whereby the mechanical efficiency of the radial piston machine is improved. Furthermore heating and wear of the drive mechanism of the radial piston machine are largely avoided.

These advantages are possible because of the bearing ring for the pistons which is arranged concentrically to the rotor and which is mounted so that it is pivotable about its symmetry axis during adjustment of the piston machine. The pivoting motion is controlled by a piston-cylinder unit or device, which is arranged to act transversely to the bearing ring, so that the radial piston machine is substantially smaller. A rotor revolution is divided into two successive working cycles for the working cylinders by pivoting the bearing ring of this type so that the feed volume or draw or pulling volume of the radial piston machine doubles with unchanged size.

Additional advantages and/or advantageous features of the invention are set forth in the appended dependent claims or description.

In a preferred embodiment of the invention the bearing ring is provided with bearing pins extending radially from opposite peripheral sides of the bearing ring.

Advantageously the adjusting device acting on the bearing ring is arranged or extends axially parallel to the bearing ring and acts on a facing surface of the bearing ring. The adjusting device can be controlled by mechanical, electromechanical, pneumatic or hydraulic control means and can be for example a piston-cylinder device.

In preferred embodiments the rotor has an even number of cylinders, the cylinders are spaced at equal angles from each other around the rotor circumference and cylinders located opposite from each other across the rotor are acted on by identical pressure levels during a rotor revolution. Advantageously the control pivot is provided with at least two feed ducts and two outlet ducts, and the feed ducts and outlet ducts are arranged alternately one after the other in a rotation direction around the rotor.

BRIEF DESCRIPTION OF THE DRAWING

The objects, features and advantages of the invention are illustrated in more detail by the following description of preferred embodiments with reference to the accompanying drawing, in which.

DESCRIPTION OF THE PREFERRED EMBODIMENT

Figure 1:
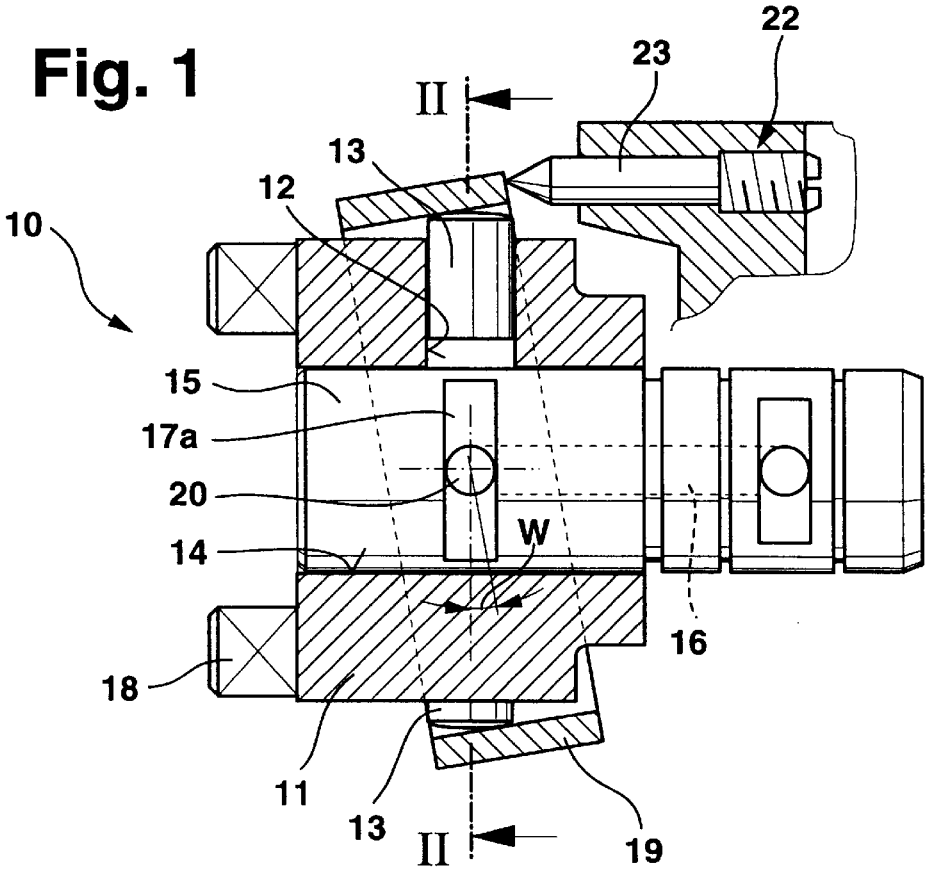
FIG. 1 is a simplified longitudinal cross-sectional view of the adjustable drive mechanism of a radial piston machine according to the invention.

Simplified view of the drive mechanism 10 of a radial piston machine is shown in a longitudinal cross-sectional view in FIG. 1, wherein a housing for the radial piston machine in whose interior space the drive mechanism 10 is normally arranged has been omitted for simplicity. A rotor 11 that has a plurality of throughgoing radial passages forming the cylinders 12 is one of the essential structural components of the drive mechanism 10. Each of the cylinders 12 extends in a radial direction in the rotor 11. The rotor 11 is provided with an even number of cylinders in the embodiment shown in the drawing, which however is not necessarily required in general in the invention. The rotor 11 rotates around a rotor or pivot axis and is rotatably mounted with its hub 14 on a control pivot 15. The control pivot 15 is arranged so as to be stationary in the housing of the radial piston machine in an unshown way and manner. Feed and/or outlet ducts 16 are provided in the control pivot 15 which end in the peripheral control cavities 17*a*,17*b*,17*c*,17*d*. The inlet side and/or outlet side peripheral control cavities 17*a*, 17*b*,17*c*,17*d* arranged successively alternating with each other in the vicinity of the bearings of the rotor 11 cooperate with the cylinders rotating past them and control them.

The driving of the rotor 11 or the drive by the rotor 11 occurs according to whether the radial piston machine operates as a pump or motor by an unshown housing-side driven or drive shaft which is nonrotatably connected with the rotor 11 by a coupling device 18. Centrifugal force acting on the working pistons 13 in the cylinders because of the rotation of the rotor 11 causes the working pistons 13 to contact a bearing ring 19 with their ends remote from or facing away from the control pivot 15. The bearing ring 19 is arranged concentric to the rotor 11 and surrounds it peripherally. The bearing ring 19 is provided with two radially protruding bearing pins 20 (FIG. 2) arranged on its exterior circumference or circumferential surface for mounting of the bearing ring pivotally in the housing. These bearing pins 20 extend in opposite directions along a transverse axis Q, which is simultaneously a symmetry axis of the bearing ring 19 and which is perpendicular in this embodiment to the rotor axis R. The bearing pins 20 allow a pivot motion of the bearing ring 19 about the transverse axis Q. The maximum pivot angle W of the bearing ring is limited however by the width of the bearing ring 19 which is adjusted to the diameter of a working piston so that it is advantageously about twice the size of the diameter of a working piston. The instantaneous pivot angle W depends on the momentary operating conditions of the radial piston machine and is controlled by an axial adjusting device 22 arranged in the housing. This adjusting device 22 can be controlled by mechanical, electromechanical, pneumatic or hydraulic means and includes an adjusting rod 23 acting as operating element, which acts on a facing side of the outer peripheral surface of the bearing ring 19. The bearing ring 19 is urged in a direction opposite to that of the adjusting device, i.e. urged back, by an unshown spring device, which simultaneously provides a firm contact of the bearing ring 19 on the adjusting rod 23. A compressed torsion spring can be used as this spring device. The torsion spring acts with a first end on at least one of the bearing pins 20 and with its second end on the housing of the radial piston machine.

Figure 2:
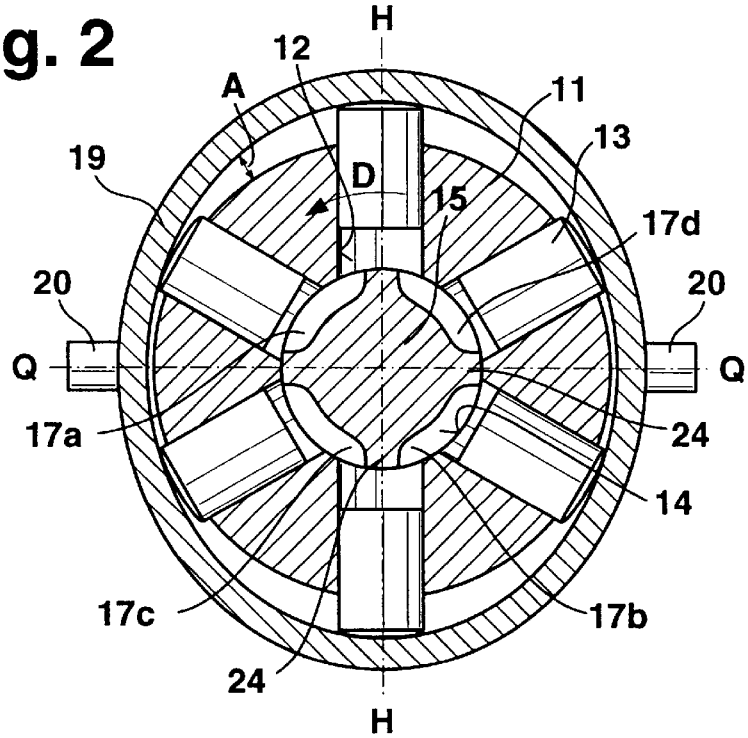
FIG. 2 is a cross-sectional view through the drive mechanism shown in FIG. 1 taken along the section line II—II of FIG. 1.

FIG. 2 shows the above-described drive mechanism 10 in cross-section with the aid of which the operation of the radial piston machine is now described.

The rotor 11 mounted on the control pivot 15 performs a rotary motion D in a counter-clockwise direction. The radial pistons 13 move radially toward the outside until they contact with their ends projecting from the rotor 11 on the inner wall of the bearing ring 19. Since the bearing ring 19, according to FIG. 1, is at an angle W relative to the rotor 11, the inner wall of the bearing ring 19 has a spacing A from the rotor, that periodically changes during the course of a rotor rotation, depending on the momentary rotation angle of the rotor 11. The spacing A takes a minimum value in the direction of the transverse axis Q of the rotor 11 and a maximum value in the direction of the vertical axis H extending perpendicular to the transverse axis Q. Accordingly the working pistons 13 are forced to move through two cycles in the cylinders during a rotor revolution, i.e. each cycle is performed when the rotor rotates through 180°. The maximum displacement during this cyclic motion is limited by the size of the pivot angle W. Both equal motion cycles per revolution of the rotor 11 have their inner turning point aligned on the transverse axis Q and their outer turning point aligned on the vertical axis H. The respective cylinders 12 are coupled with a feed and/or outlet duct 16 by means of the control cavities 17*a*,17*b*,17*c*,17*d* in synchronization with the motion direction of their working pistons 13 during these motion cycles. The control cavities are arranged in the control pivot 15 so that each cylinder of each pair of cylinders opposite from each other across the rotor is acted on with the same pressure level. Separating members 24 between the control cavities 17*a*,17*b*,17*c*,17*d* act together with the hub 14 of the rotor 11 to seal the feed and outlet ducts 16 from each other. The cyclic motion of the working pistons 13 permits a pressure medium flow from the feed to the outlet duct 16 or vice versa, during which a compression energy is imparted to or withdrawn from the pressure medium and is converted into a drive moment according to the type of radial piston machine, pump or motor.

The amount of the conveyed or forced pressure medium is controlled by the instantaneous operating conditions of the radial piston machine and can be controlled by the pivot angle W of the bearing ring 19 (FIG. 1). Since cylinders located opposite from each other are acted on continuously with an identical pressure level during their motion cycles, the hydraulic forces produced on the rotor 11 of course have the same magnitude, but act in opposite direction. The rotor 11 thus rotates with the forces on the control pivot 15 balanced so that frictional forces degrading efficiency and causing wear are avoided.

Understandably changes or additions to the embodiments described above are conceivable, without changing the essential features of the invention.

In this connection an especially effective balancing of the forces on the bearing positions of the rotor 11 is achieved when the rotor 11 has an even number of cylinders distributed uniformly or evenly over its entire circumference. Particularly to reduce the pulsations of the feed or the delivered drive moment of the radial piston machine as much as possible as large a number of cylinders as possible must be used. A particularly compact and strong structure is obtained for the drive mechanism 10 when between five and eight cylinders 12 are provided in the rotor 11. It is particularly desirable to minimize the friction between the working pistons 13 and the bearing ring 19 by means of a multi-part bearing ring 19. This multi-part bearing ring has at least one inner ring surrounding the working pistons, which is slidably mounted in an outer ring or which is mounted with rollers in an outer ring.

The disclosure of German Patent Application 197 03 155.2-15 of Jan. 29, 1997 is hereby explicitly incorporated by reference. This German Patent Application discloses the same invention as described herein and claimed in the claims appended hereinbelow and is the basis for a claim of priority for the instant invention under 35 U.S.C. 119.

I claim:

1. An adjustable radial piston machine comprising a housing having an interior space, a drive mechanism (10) arranged in the interior space of the housing, said drive mechanism (10) including a rotor (11) coupled nonrotatably to a drive or driven shaft outside the housing, wherein said rotor (11) is provided with a plurality of radially arranged cylinders (12) and working pistons (13) guided movably in the respective cylinders;

a stationary control pivot (15) on which the rotor (11) is rotatably mounted for rotation about a rotor axis, said control pivot (15) being provided with at least one feed duct and/or outlet duct (16) opening into respective control cavities (17*a,* 17*b,* 17*c,* 17*d*) between the control pivot (15) and the rotor (11);

a bearing ring (19) surrounding the rotor (11) on which the working pistons (13) bear; and an adjusting device (22) with which the bearing ring (19) cooperates for adjustment of the radial piston machine during operation of the radial piston machine;

wherein said bearing ring (19) is arranged concentric to said rotor (11), has a symmetry axis (Q,H) and is pivotally mounted for pivoting about said symmetry axis (Q,H).

2. The adjustable radial piston machine as defined in claim 1, wherein said bearing ring (19) is provided with bearing pins (20) for pivoting about said symmetry axis and said bearing pins extend radially from opposite sides of said bearing ring (19).

3. The adjustable radial piston machine as defined in claim 1, wherein the adjusting device (22) acting on the bearing ring (19) is arranged or extends axially parallel to the bearing ring and acts on a facing surface of the bearing ring (19).

4. The adjustable radial piston machine as defined in claim 3, further comprising mechanical, electromechanical, pneumatic or hydraulic means for controlling said adjusting device (22).

5. The adjustable radial piston machine as defined in claim 1, wherein said rotor (11) has an even number of said cylinders (12), said cylinders (12) are spaced at equal angular intervals from each other around a circumference of said rotor (11) and pairs of said cylinders (12) opposite from each other across said rotor are acted on by identical pressure levels during a rotor revolution.

6. The adjustable radial piston machine as defined in claim 1, wherein the control pivot (15) has at least two of said feed ducts and at least two of said outlet ducts, and said feed ducts and said outlet ducts are arranged so as to alternate one after the other in a rotation direction around said rotor.

* * * * *